United States Patent [19]

Takase

[11] 4,336,593

[45] Jun. 22, 1982

[54] DATA PROCESSING SYSTEM FOR ELECTRONIC CONTROL OF AUTOMOTIVE VEHICLE DEVICES WITH NOISE PREVENTION

[75] Inventor: Sadao Takase, Yokohama, Japan

[73] Assignee: Nissan Motor Company, Ltd., Yokohama, Japan

[21] Appl. No.: 123,649

[22] Filed: Feb. 22, 1980

[30] Foreign Application Priority Data

Feb. 26, 1979 [JP] Japan ..... 54-20773

[51] Int. Cl.[3] ..... G06B 1/08; G06B 15/02

[52] U.S. Cl. ..... 364/431; 123/488; 340/146.2; 364/574

[58] Field of Search ..... 364/431, 424, 574; 340/146.2; 123/480, 488, 494; 307/352–362

[56] References Cited

U.S. PATENT DOCUMENTS

| | | | |
|---|---|---|---|
| 3,701,144 | 10/1972 | Fineran et al. | 307/352 X |
| 3,757,298 | 9/1973 | Tumbush | 340/146.2 |
| 3,794,981 | 2/1974 | O'Connor | 340/146.2 X |
| 3,845,465 | 10/1974 | Hosick et al. | 340/146.2 |
| 4,155,332 | 5/1979 | Yaegashi et al. | 123/494 X |
| 4,166,271 | 8/1979 | Thirlwall et al. | 340/146.2 |
| 4,181,944 | 1/1980 | Yamauchi et al. | 364/431 |
| 4,200,064 | 4/1980 | Engele | 123/480 X |
| 4,201,159 | 5/1980 | Kawai et al. | 123/480 X |

*Primary Examiner*—Felix D. Gruber

*Attorney, Agent, or Firm*—Schwartz, Jeffery, Schwaab, Mack, Blumenthal & Koch

[57] ABSTRACT

The data processing system generally comprises a CPU, one or more memory units and an input unit. The input unit is capable of discriminating between signals contaminated with noise and noise free signals. Only noise free signals are stored for processing by the CPU. In one embodiment, the input unit determines whether an input signal value is within a predetermined range. If the signal value is within the range, it is stored. If the signal value is outside of the range, the input unit operates to determine the difference between successive values of the signal. If the difference between successive sequential values does not vary beyond a predetermined range for a predetermined time, the signal is regarded as being correct and the present value is stored for processing by the CPU. Otherwise, a preceding value is stored for processing by the computer.

12 Claims, 5 Drawing Figures

DATA PROCESSING SYSTEM FOR ELECTRONIC CONTROL OF AUTOMOTIVE VEHICLE DEVICES WITH NOISE PREVENTION

BACKGROUND OF THE INVENTION

1. Field of the Invention

The present invention relates generally to a data processing unit employing a microcomputer unit, which is mounted on an automotive vehicle. More specifically, the present invention relates to an improvement for the input unit of a data processing unit which is capable of eliminating noise contained in sensor signals or preventing a data processing system malfunction caused by input signal containing noise.

2. Description of the Related Art

As is known to those skilled in the art, in recent years, it has become quite popular to automatically control various vehicle systems by using a data processing unit including a microcomputer unit. The data processing unit is employed on the automotive vehicle for automatically controlling internal combustion engine systems such as the ignition system, exhaust gas recirculation system, fuel injection system and so on. The data processing system is further utilized for controlling various vehicle indicators, such as, for example, a navigation meter. Further, the data processing system is used for controlling various vehicle equipment, such as an automatic tuning device for a radio receiver of the vehicle mounted type. As stated above, the data processing system can be utilized for controlling various means or devices on the vehicle. An engine control system first detects various engine running variables such as air flow rate, engine speed, and temperature, and then controls the fuel injection amount, ignition timing, and exhaust-gas recirculation rate, and provides alarms indicative of abnormal states, based on these detected sensor signals. However, the detected signals are subject to noise interference. If such erroneous signals are applied to the engine control system, it becomes impossible to control the system under optimal conditions, and therefore the engine running performance, exhaust gas purification performance, and so on may deteriorate.

In addition to these problems, if the sensor signals are affected by noise, spurious alarms for catalyst temperature, for example, may be generated. This is at least an annoyance to the driver, but could possibly be a dangerous distraction.

Such abnormal signals may result not only from noise but also from noise-disturbed malfunctions of signal input devices such as A-D convertors or counters.

Causes of the signal disturbance include electrical noise (for example, ignition signals) interfering with the input line, while causes of A-D convertor malfunctions include electrical noise interfering with the power supply line.

The above A-D converter malfunction can readily be prevented by providing means to separate the power supply line into another system. However, it is very difficult and costly to completely eliminate electric noise from the input line by only providing conventional shield wires or filters, since the sensors detecting various engine running variables are usually positioned in the engine compartment and are thus positioned in the vicinity of noise sources such as ignition devices.

The present invention provides an improved data processing system which is capable of eliminating harmful effects caused by noise contained in the input signals fed from various sensors.

SUMMARY OF THE INVENTION

Therefore, it is an object of the present invention to provide a data processing system having means for discriminating whether an input signal contains noise which may cause an error in processing the data for controlling various vehicle systems, such as engine driving systems, indicators and other equipment of the vehicle.

Another object of the present invention is to provide a data processing system having an improved input unit which includes a means for eliminating effects of noise contained in the input signals.

A further object of the present invention is to provide a data processing system having an improved input unit which includes means for correcting the input signal with reference to preceeding data stored in a memory unit thereof.

A still further object of the present invention is to provide a data processing system processing input data by sequential steps including a step checking whether the input data is in a normal range and a step updating storage of the memory unit of the input unit for outputting the updated data.

In accordance with the above and other objects, a data processing system according to the present invention is provided with an input unit for storing input signals received from engine sensors and presenting the stored signals to a central processing unit. The input unit includes a device for preventing the input unit from updating the storage of signal values which have been contaminated by noise. In one embodiment, the noise preventive device includes a discriminator for determining whether the inputted sensor value is within a given normal range. If the inputted sensor signal value is out of the normal range, then the discriminator operates to determine the difference between successive sensor signal values to determine whether substantial varying of the sensor signal has temporarily occurred. If not, the discriminator regards the sensor signal as correct and permits updating of the storage in the input unit with the inputted sensor signal.

Specifically, in this embodiment of the present invention, the input unit incorporated in the data processing system has an input register for temporarily storing inputted sensor signal values indicative of various engine control parameters. The input register can be updated with an inputted sensor signal value. A discriminator incorporated in the input unit and interpositioned between the input register and sensor compares the inputted sensor signal value with a predetermined first reference value defining a normal varying range of the sensor signal values in order to determine if the sensor signal value is in the normal range. If the sensor signal value is outside of the range, the discriminator further determines the difference between sensor signal values sequentially inputted and compares the determined difference with a predetermined second reference value defining an allowable range of the sensor signal difference. The discriminator measures the period of time during which the sensor signal difference is maintained in the allowable range, compares the measured period of time with a predetermined period and generates a command signal if the measured period is shorter than the predetermined period. A switch interpositioned between the sensor and the input register, cooperates with the discriminator. The switch is switched between a first position communicating the sensor and the input register, and a second position blocking communication between the sensor and the input register.

According to another aspect of the present invention, there is provided a method for preventing a data processing system from failure in operation due to the effect of noise generated while the vehicle is driven. The method includes a process for discriminating whether a sensor signal inputted to an input unit of the data processing system is in a given normal range. When the sensor signal value is out of the given normal range, then the difference between successive sensor signal values is determined and compared to a predetermined allowable range. The period during which the determined difference is maintained in the predetermined allowable range is measured and compared with a predetermined period. If the measured period is longer than that of the predetermined period, the sensor signal is regarded as correct and the storage in the input unit is updated with the sensor signal. If the measured period is shorter than that of the predetermined period, updating of the storage in the input unit is blocked.

The other objects and advantages of the present invention will become clear from the hereafter described preferred embodiment of the present invention.

BRIEF DESCRIPTION OF THE DRAWINGS

The present invention will become more fully understood from the detailed description given hereinbelow, and from the accompanying description of several preferred embodiments of the present invention, which however, are not to be taken as limitative of the present invention in any way, but are for the purpose of elucidation and explanation only.

In the drawings.

DESCRIPTION OF THE PREFERRED EMBODIMENT

Figure 1:
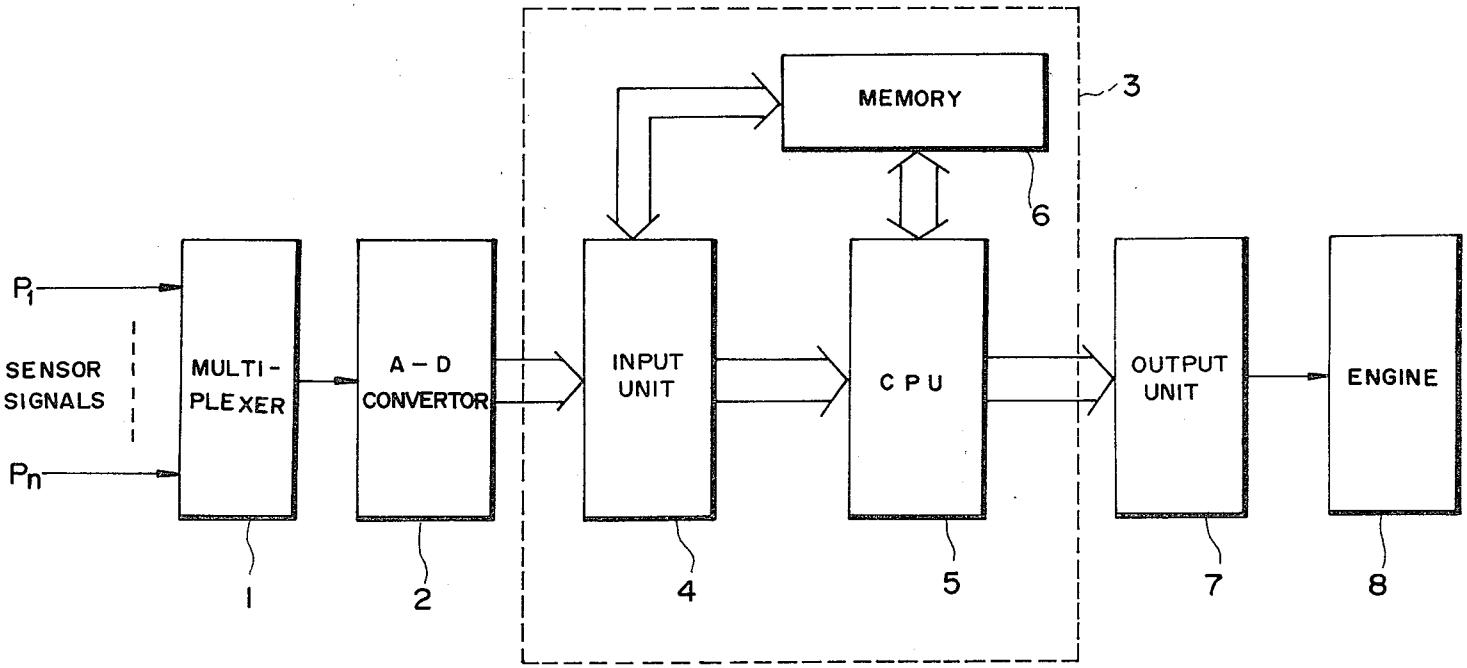
FIG. 1 is a schematic block diagram of one construction of a data processing system embodying the present invention.

Referring now to the drawings, particularly to FIG. 1, there is schematically illustrated and shown a general data processing system including a microcomputer unit for an automotive vehicle. The data processing unit is employed on the automotive vehicle for automatically controlling internal combustion engine systems such as the ignition system, exhaust gas recirculation system, fuel injection system and so on. As shown in FIG. 1, a microcomputer unit 3 comprises, in general, an input unit 4, central processing unit (CPU) 5 and one or more memory units 6 including a read-only memory (ROM) and/or a random access memory (RAM). An output unit 7 is connected to the microcomputer unit 3 for outputting the result of operations executed in the CPU 5. However, even though the output unit 7 is shown separated from the microcomputer unit 3, it will be understood that the microcomputer unit 3 per se may include the output unit 7 therein. Since input signals from various sensors provided for detecting or measuring engine driving parameters are provided in various forms such as, for example, analog signals, pulse signals, frequency signals and so on, it may be necessary to convert certain signals into digital form for application to the microcomputer unit 3. In the example shown, there is provided an analog-digital converter (A/D converter) 2 for this purpose. Further, in the example shown there is provided a multiplexer unit 1 for inputting sensor signals by way of time sharing.

To the multiplexer unit 1, various sensor signals $P_1$ to $P_n$ are provided from the sensors. Signals $P_1$ to $P_n$ represent a plurality of driving parameters, such as, for example, air flow rate, engine speed and engine temperature. These parameters are input to the data processing system for controlling the engine. By use of the result of operations in the data processing system, fuel injection rate of the fuel injection system, spark timing of the ignition system, and recirculation rate of the exhaust-gas recirculation (EGR) system, for example, are controllable.

Figure 2:
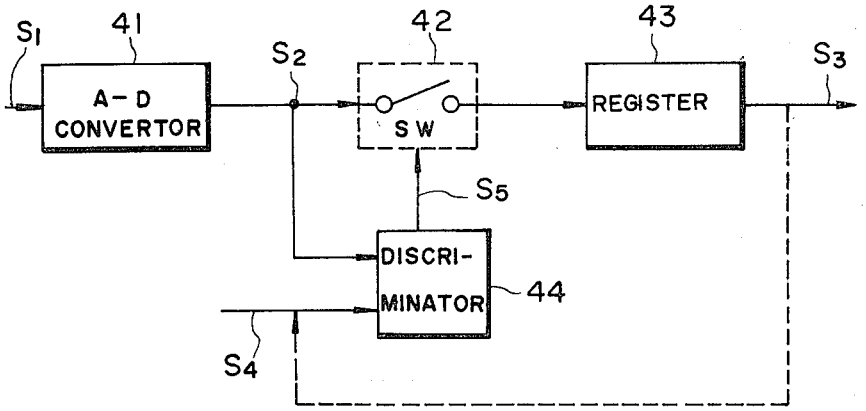
FIG. 2 is a block diagram of one embodiment of an input unit of the present invention included in the data processing system of FIG. 1.

In FIG. 2, there is illustrated and shown in detail the input unit 4 according to the first embodiment of the present invention. The input unit 4 in FIG. 1 generally comprises an input-register 43 as primary storage for the input data and a discriminator 44 for comparing the difference between a reference signal and the input signal to a predetermined value to decide whether the input signal is in a normal range or in an abnormal range. A switching member 42 is connected between the input-register and A/D converter 41. A sensor signal $S_1$ containing data, such as air flow rate, engine speed, engine temperature and so on is converted to a digital signal $S_2$ through the A/D converter 41. It should be appreciated that, although in this embodiment the A/D converter 41 is employed for converting an analog input signal, no converters for digital signals need be employed. Further, it should be noted that the A/D converter 41 employed in this embodiment will function as a device for inputting the input signal to the input-register 43. The input signal $S_2$ is inputted to the register 43 through the switching member 42. At the same time, the input signal $S_2$ is transmitted to the discriminator 44. In the discriminator 44, the difference between the input signal $S_2$ and a reference signal is compared with a predetermined value signal. The reference signal and predetermined value are generated by a signal generating means (not shown) and transmitted to the discriminator 44 and indicated as signal $S_4$. It is unnecessary for the input signals $S_2$ to be identical to the reference signal $S_4$. It is merely necessary for the input signal to be in a proper range for control of the engine. For this reason, the signal $S_4$ contains the predetermined value which defines a range to be regarded as normal. It will be obviously understood that for defining the allowable range of the input signal, there are various ways other than the foregoing. For example, it would be possible to use two different reference signals one of which defines an upper limit of the allowable range and the other of which defines a lower limit. When the input signal $S_2$ is in abnormal range, the discriminator generates a command signal $S_5$. The command signal $S_5$ is transmitted to the switching member 42 to turn the switching member 42 off. Therefore, the input signal $S_2$ is not inputted to the input-register 43 so as not to update the storage thereof. When the signal is in the normal range, the command signal $S_5$ is not generated and thus the switching member 42 remains on. Thus, the input signal $S_2$ is inputted to the input-register 43 in synchronism with a sync signal generated by a clock signal generating means (not shown). In the case, the contents of the input-register 43 are updated by the next input signal inputted in synchronism with the sync signal. Meanwhile, as will be well known to those skilled in the art, there are various ways for inputting an input signal or data into a memory unit. For example, in the case where the input signals are sequentially stored in the memory unit, the contents of the memory are updated in accordance with the input signals.

When the input signal is in an abnormal range and, therefore is not inputted to the input-register 43, the stored preceding data will be outputted as control data for operation of the CPU.

In the above-mentioned embodiment, the reference signal is inputted from outside of the data processing system. It would also be possible to use the output signal $S_3$, comprising preceding data of the input signal, as the reference signal. In this case, as shown in the dotted line in FIG. 2, the output signal $S_3$ is fed back to the discriminator 44 to be compared with the input signal for deciding whether the input signal $S_2$ is in a normal range. The difference of the signals $S_2$ and $S_3$ would be compared with the predetermined value. If the difference exceeds the predetermined value, the discriminator 44 will make a decision that the input signal is in an abnormal range. Further, a rate of change detecting means can be employed as discriminator 44. In this case, the rate of change of signal $S_2$ is measured and, if the rate of change value of the input signal $S_2$ exceeds a predetermined value, it will be considered abnormal.

Furthermore, it is possible to decide whether the input signal $S_2$ is in a normal range by measuring to determine if the continuing time duration of the signal is in a predetermined range. When the continuing time duration is shorter than the predetermined range, the input signal is considered abnormal. Alternatively, it would be possible to consider the input signal to be abnormal when signals outside of a predetermined range are continuously or repeatedly inputted for more than a given period of time or for a predetermined number of operation cycles of the data processing unit.

It will be appreciated that the above-mentioned input unit comprising switching member 42, input-register 43 and discriminator 44 can be implemented by using microcomputer programming.

Figure 3:
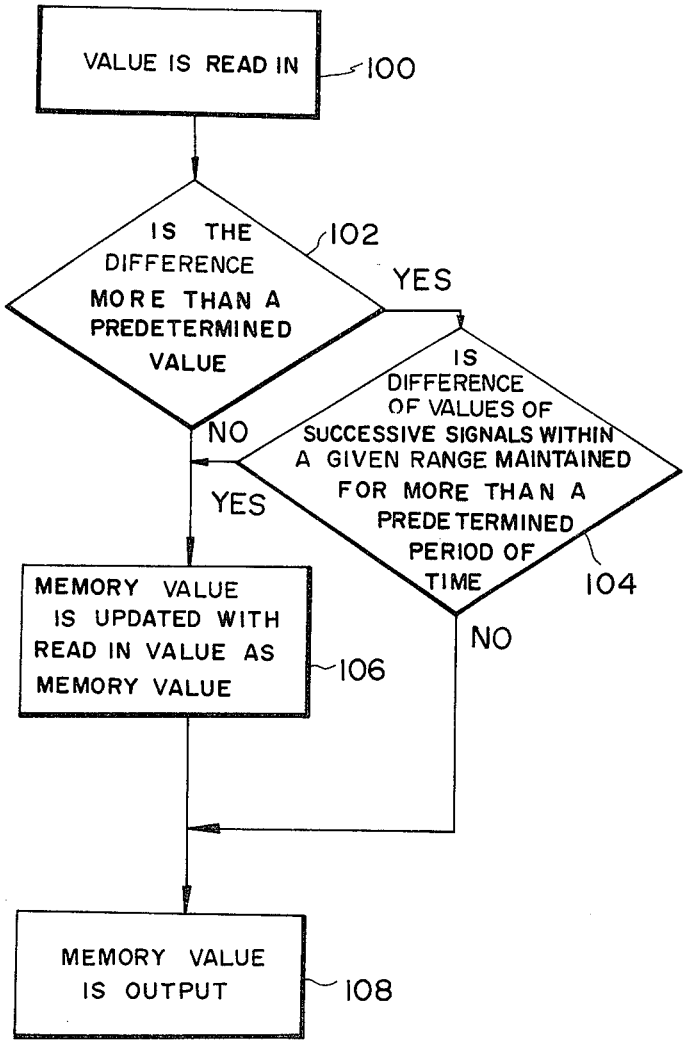
FIG. 3 is operational flowchart for a program to be executed by the present invention for checking whether input signals are in normal range with respect to a given normal range.

FIG. 3 shows a flowchart of a program for checking whether the input signals are in a normal range. As will be apparent from FIG. 3, there is disclosed a program for checking the input signal by checking the difference of the value between input signal $S_2$ and the reference signal $S_4$. In process step 100, an input signal is inputted to the input-register 43. The input signal $S_2$ is then compared to the reference signal $S_4$ to determine the difference of values therebetween. In decision step 102, the difference of the values between the input signal $S_2$ and the reference signal $S_4$ is compared with the predetermined value. When the difference exceeds the predetermined value, the program skips to a decision step 104. In step 104, the input signal $S_2$ is checked to see if the difference of values between successive input signals is within a given range and is maintained for a duration exceeding a predetermined period of time. If the result of the check of step 104 is "YES", the program skips to process step 106 in which the input signal $S_2$ is used to update the storage of the input-register 43. If the difference between successive signals $S_2$ is maintained within a given range less than the predetermined period of time, the program skips to process step 108 in which the previous stored data in the input-register 43 is outputted. At this time, the storage of the input-register 43 is not updated by the input signal $S_2$. Accordingly, even when the difference between input signal $S_2$ and the reference signal $S_4$ exceeds the predetermined value, when the difference between successive input signals $S_2$ is within a given range and is maintained longer than a predetermined period of time, the input signal $S_2$ is considered normal and used to update the storage of the input-register 43. By this program, if the input signals are normal but rapidly change in value, they can update the storage of the input-register 43.

Figure 4:
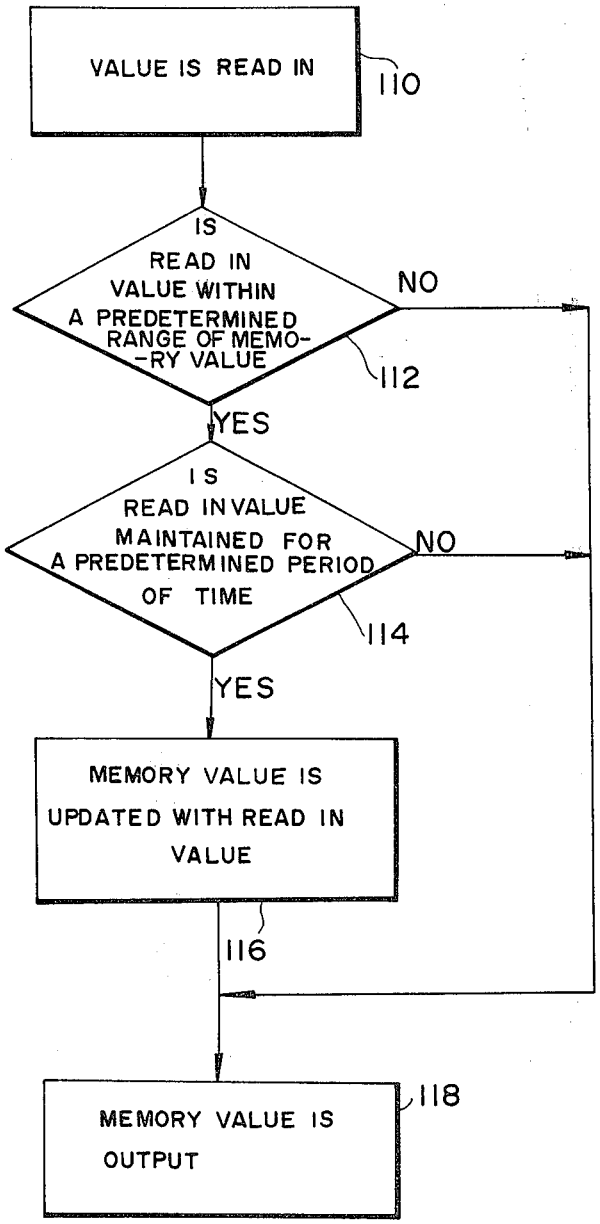
FIG. 4 is operational flowchart showing another example of a program for checking whether input signals are in a given normal range.

Now, with reference to FIG. 4, a modification of the function of the above-mentioned embodiment will be set forth. FIG. 4 shows a flowchart of a checking program for use with a microcomputer system. In process step 110, the input signal $S_1$ is inputted to the input unit and to the input-register 43 as a converted digital input signal $S_2$. In decision step 112, the input signal $S_2$ is checked to see whether a change in the value of the input signal $S_2$ with respect to a preceding input signal value is within a given range. When the difference of successive values of the input signal $S_2$ is within the given range, the input signal $S_2$ is further checked to see whether the value of the input signal is maintained for a given period without changing, on a decision step 114. When, the constant value of the signal $S_2$ is maintained for the given period, the input signal $S_2$ is registered in the input-register 43 to update the storage thereof. If either on the step 112 or the step 114, the decision is NO, the program step jumps to a process step 118 on which the storage of the input-register 43 is outputted to be processed.

Figure 5:
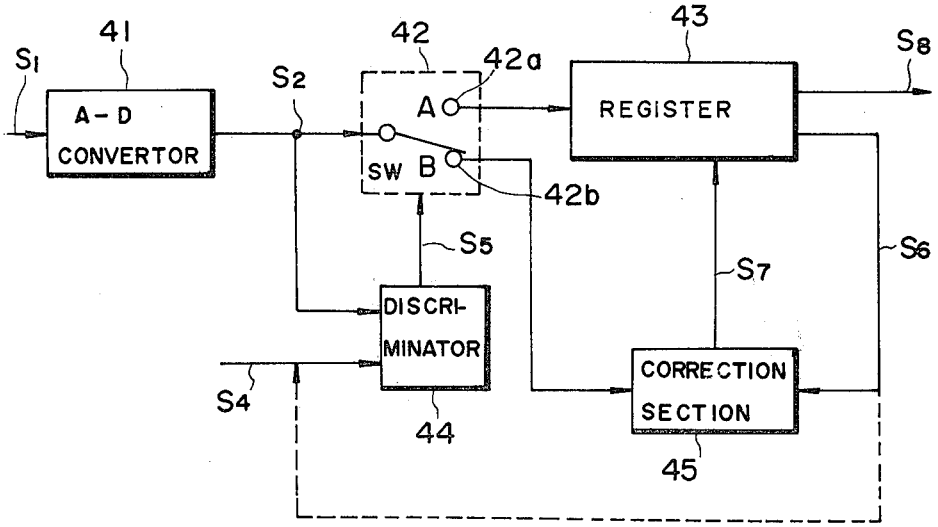
FIG. 5 is a block diagram of an input unit according to another embodiment of the present invention.

The present invention has been illustrated hereabove with respect to one specific embodiment, however, it would be possible to employ various constructions of the circuits and/or various structures of the checking program. As an example, FIG. 5 shows another circuit for checking and updating the storage of the input-register. It should be noted that the features and elements which are substantially the same as in the former embodiment will be designated by the same reference numerals for simplification of the following explanation. In FIG. 5, between an A/D converter 41 and an input-register 43, there is connected a switching member 42 having two terminals **42*a* and 42*b* to be alternatively switched. A discriminator 44 is provided to discriminate the input signals with reference to reference signals $S_4$. There is further provided a signal correction circuit 45. One of the switching terminals 42*a* is connected between the A/D converter 41 and the input-register 43 and the other switching terminal 42*b* is connected between the A/D converter and the signal correction circuit 45. When the input signal $S_2$ is inputted to the input unit, the signal $S_2$ is fed to the discriminator 44 and the input-register 43. In the discriminator 44, the input signal $S_2$ is checked to see whether it is in a normal range, by way of comparing the same with the reference signal $S_4$, for example. When the input signal is determined to be abnormal, a command signal $S_5$ is generated in the discriminator 44 to change the position of the switching member 42 from the first position connected to the terminal 42***a* to the second position connected to the terminal 42*b*. Thereby, the input signal $S_2$ is fed into the signal correction circuit 45 in which the signal $S_2$ is corrected based on the stored signal $S_6$ which is the value of the preceding signal $S_2$ taken from the register 43. The signal correction circuit 45 outputs a corrected input signal $S_7$ to the input-register 43. By use of the corrected input-signal $S_7$, the storage of the input-register 43 can be updated. It should be appreciated that the correction circuit 45 outputs a corrected signal $S_7$ of signal $S_2$ so that the deviation between signal $S_2$ and $S_6$ may be within the given range. By employing the correction circuit in the input unit, it if possible to improve the response characteristics when the input signal $S_2$ changes abruptly.

As described above, according to the present invention, the engine control system is prevented from disruption by noise since abnormal sensor signals can effectively be eliminated, and therefore running of an automotive vehicle and purification performance of the exhaust gas are effectively improved since optimal control is performed at all times. In addition to these advantages, although the operational variables of an internal combustion engine vary widely and therefore it is very difficult to discriminate accurately between normal signals and noise, the present invention makes it possible to accurately determine the difference and also to perform optimal control. Also, if a microcomputer is used for the engine control system, no increase in cost is needed because it is possible to apply the present invention by simply altering the computer program.

It is further to be understood by those skilled in the art that the foregoing description is of preferred embodiments of the present invention and that various changes and modifications may be made without departing from the spirit and scope thereof.

What is claimed is:

1. A data processing system for an automotive vehicle electronic control for controlling various vehicle functions, said system having an input unit, a central processing unit and one or more memory units, at least one of said memory units being associated with said input unit, said input unit being in communication with various sensing elements for detecting vehicle control parameters, said system further comprising, in combination:

means for receiving an input signal from one of said sensing elements and inputting said input signal to said input unit;

means within said input unit for comparing said input signal with a reference signal to determine whether said input signal is within a predetermined range and outputting selected values of said input signal, said selected values being present values of said input signal when said input signal is within said predetermined range; and means for storing said outputted selected values and outputting said stored selected values to said central processing unit, said storing means comprising said at least one memory unit associated with said input unit.

2. The system as set forth in claim 1 wherein said comparing means includes means for determining whether the difference between successive values of said input signal is within predetermined difference limits when said input signal is outside of said predetermined range, and wherein said comparing means outputs present values of said input signal as said selected values when said input signal is outside of said predetermined range and the difference between successive input values stays within said predetermined difference limits for a predetermined time duration.

3. The system according to claim 2, wherein said reference signal comprises upper and lower reference limits for said predetermined range.

4. The system as set forth in claim 1, wherein said input unit further comprises means for correcting said input signal, said correcting means being responsive to said means for comparing to produce corrected present values when said input signal is determined to be outside of said predetermined range, said comparing means outputting said corrected present values as said selected values.

5. The system according to claim 1, wherein said parameters include air flow rate, engine revolution rate and engine temperature.

6. The system according to claim 1, wherein said engine functions include fuel injection and ignition timing.

7. A noise prevention device for use in a data processing system for an automotive vehicle electronic control, said system controlling automotive fuel injection, spark ignition timing, engine speed and other engine operating conditions, said device being operative to prevent the effects of noise generated by spark ignition and other engine functions from detrimentally affecting operation of said system, said device comprising:

an input unit having an input register temporarily storing inputted sensor signal values indicative of various engine operating parameters, said input register being capable of being updated with present sensor signal values in place of previous sensor signal values;

discriminator means for receiving inputted sensor signals and comparing successive sensor signal values with a predetermined first reference signal defining a varying input signal range to determine when said successive sensor signal values are in said input signal range; and, when said successive sensor signal values are outside of said input signal range, producing differences between said successive sensor signal values and comparing said differences with a second reference value defining an allowable difference range, and measuring the period of time during which said differences are maintained in said allowable difference range; said discriminator means comparing said measured period with a predetermined period and producing a command signal if said sensor signal values are out of said input signal range and said measured period is shorter than said predetermined period; and switch means for applying said sensor signal values to said input register, said switch means being responsive to said discriminator means for applying said inputted sensor signal values to said input register only in the absence of said command signal.

8. The device as set forth in claim 7, wherein said first reference signal is derived from the value stored in said input register.

9. In a data processing system for controlling various vehicle functions on an automotive vehicle and including an input unit, a central processing unit, and a memory unit, a method for eliminating noise from signals input to the system, comprising:

inputting a sensor signal to said input unit;

comparing successive values of said sensor signal with predetermined values defining a normal range for said sensor signal and generating a first command signal when said sensor signal values are out of said normal range;

generating difference signals related to the difference of successive sensor signal values and comparing said difference signals with a predetermined difference reference value in response to said first command signal;

measuring a period in which said difference signals are in a given range with respect to said predetermined difference reference value and comparing said measured period with a predetermined reference period and generating a second command signal when said measured period is shorter than said predetermined reference period;

providing a previous value of said sensor signal to said central processing unit in response to said second command signal; and storing and providing a present value of said sensor signal to said central processing unit when either said first command signal or said second command signal is not generated.

10. A method according to claim 9 and further including the step of generating said predetermined values defining a normal range externally of said input unit.

11. The method according to claim 9, wherein said step of comparing successive sensor signal values with predetermined values comprises the step of calculating the difference between said sensor signal values and said predetermined values.

12. A method for preventing a data processing system in an electronic engine control for an automotive vehicle from failure of operation due to input signals contaminated by noise, comprising:

receiving a sensor signal from a sensing element and inputting said sensor signal to an input unit;

comparing successive values of said sensor signal with a first predetermined value to determine whether said sensor signal is within a normal range;

storing the present value of said sensor signal and inputting said present value to said data processing system when said sensor signal is within said normal range;

determining the difference between successive values of said sensor signal when said sensor signal is outside of said predetermined range, and comparing said determined differences with a second predetermined value and measuring the period of time during which said determined differences are within a predetermined range of said second value when said sensor signal is not within said normal range;

comparing said measured period with a predetermined reference period; and storing and applying the present value of said sensor signal to said data processing system when said measured period is greater than said predetermined reference period.

* * * * *